US006926745B2

(12) United States Patent
Scheuing et al.

(10) Patent No.: US 6,926,745 B2
(45) Date of Patent: Aug. 9, 2005

(54) HYDROSCOPIC POLYMER GEL FILMS FOR EASIER CLEANING

(75) Inventors: David R. Scheuing, Danville, CA (US); Malcolm DeLeo, Castro Valley, CA (US); Sara Morales, Bay Point, CA (US)

(73) Assignee: The Clorox Company, Oakland, CA (US)

( * ) Notice: Subject to any disclaimer, the term of this patent is extended or adjusted under 35 U.S.C. 154(b) by 0 days.

(21) Appl. No.: 10/263,605

(22) Filed: Oct. 2, 2002

(65) Prior Publication Data

US 2003/0220223 A1 Nov. 27, 2003

Related U.S. Application Data

(63) Continuation-in-part of application No. 10/150,363, filed on May 17, 2002.

(51) Int. Cl.[7] ..... D06M 10/08; B05D 1/00; C11D 3/37

(52) U.S. Cl. ..... 8/115.51; 8/181; 8/115.54; 427/155; 427/421

(58) Field of Search ..... 8/115.51, 181, 8/115.54; 427/155, 421

(56) References Cited

U.S. PATENT DOCUMENTS

| | | | | |
|---|---|---|---|---|
| 4,353,745 A | * | 10/1982 | Ebbeler | 106/2 |
| 6,242,046 B1 | * | 6/2001 | Nakane et al. | 427/354 |
| 6,251,849 B1 | | 6/2001 | Jeschke et al. | |
| 6,331,517 B1 | | 12/2001 | Durbut | |

FOREIGN PATENT DOCUMENTS

| | | | | |
|---|---|---|---|---|
| WO | WO 95/07971 | | 3/1995 | |
| WO | WO 99/54414 | * | 10/1999 | C09D/5/16 |
| WO | WO 00/29538 | | 5/2000 | |
| WO | WO 00/77143 | * | 12/2000 | C11D/3/37 |
| WO | WO 02/18531 | | 3/2002 | |
| WO | WO 02/070612 | | 9/2002 | |

* cited by examiner

*Primary Examiner*—Brian P. Mruk
(74) *Attorney, Agent, or Firm*—Cascio Schmoyer & Zervas

(57) ABSTRACT

Hydroscopic polymer gels can be formed by applying a water soluble or water dispersible polymer on a surface and allowing water to be sequestered from the atmosphere into the polymer. The polymer gels provides for easier next time cleaning. In addition, the surfaces of textiles and related materials can be engineered by the formation of polymer gel films thereon. Polymer gels also provide a vehicle by which sites of chemical reactions can be localized.

45 Claims, No Drawings

HYDROSCOPIC POLYMER GEL FILMS FOR EASIER CLEANING

REFERENCE TO RELATED APPLICATION

This application is a continuation-in-part application of U.S. patent application Ser. No. 10/150,363 filed on May 17, 2002, pending, which is incorporated herein in its entirety.

FIELD OF THE INVENTION

The invention is directed to a polymer containing cleaning composition for hard surfaces whereby treated surfaces exhibit excellent water-spreading and oil-repellence even after the surfaces have been rinsed several times with water. Thus treated household surfaces, for example, will remain clean for a longer period of time. The polymers can be adsorbed on the surface and modify the properties of the surface through the formation of films containing water that is drawn from the ambient environment.

BACKGROUND OF THE INVENTION

Consumers are dissatisfied with their cleaner's ability to prevent soils, such as soap scum, toothpaste, hard water, greasy soils, brake dust, grime, rust, and toilet ring, from building up on household surfaces. Specifically, consumers want surfaces to maintain their cleaned look for longer periods of time.

One approach to solving this problem entails applying a sacrificial layer of material which is dissolvable by water with the attendant removal of dirt. Suitable cleaning formulations must be carefully applied in order to create a sufficiently thick, dry sacrificial film. Unfortunately, inconsistent consumer cleaning habits make this an almost impossible task. In many cases, the surface is rinsed before the film is dried thereby creating a sacrificial coating that is too thin to prevent soils from adhering. In cases where the sacrificial coating is too thick, an unsightly macroscopic film with visible residue is created.

U.S. Pat. No. 6,331,517 to Durbut describes an aqueous glass cleaning composition comprising an anionic surfactant and a hydrophilic, anionic maleic acid-olefin copolymer. The surface becomes hydrophilic such that the initial contact angle of water on the treated surface is from 12 to 23 degrees. While the presence of the copolymer yields an efficient hydrophilic surface coating, this sacrificial coating is easily rinsed away unless it is very thick.

U.S. Pat. No. 6,242,046 to Nakane et al. describes a more permanent stain-proofing treatment that employs a non-water soluble resin and a metal oxide sol. With this treatment, the surface must be washed with water before the film dries on the surface. This step appears to homogeneously spread a stainproof-treating agent on the surface and removes excess stainproof-treating agents. When washing with water is not done properly, however, the excess causes surface nonuniformity.

WO 00/77143 to Sherry et al. describes a surface substantive polymer which purportedly renders treated surfaces hydrophilic. The preferred polymers include a copolymer of N-vinylimidazole N-vinylpyrrolidone (PVPVI), a quaternized vinyl pyrrolidone/dialkylaminoalkyl acrylate or methacrylate copolymer, or a polyvinylpyridine-N-oxide homopolymer. These polymers are proported to modify the surface to achieve water to treated surface contact angles of less than 50 degrees.

U.S. Pat. No. 6,251,849 to Jeschke et al. describes a cleaner for easier next time cleaning that contains a cationic polymer comprising at least 40 mole percent of a quarternary monomer such as methacrylamidopropyl trimethylammonium chloride. The cleaning performance is said to improve with the presence of these polymers in the cleaner but it is expected that the wetting properties will decline after a single rinse step.

A second approach to preventing soil buildup is to deposit a release aid on the treated surface to modify surface characteristics. Unfortunately, the application of cleaner or water causes the soluble release aid to be completely removed. WO 02/18531 to Ashcroft et al. describes the use of cleaning solutions containing antioxidants that function as soil release agents. The antioxidants are purportedly retained on the surface so that soil subsequently deposited thereon is prevented from polymerizing thereby allowing for easier removal. However, it is expected that the antioxidants will not be effective on all soil types.

WO 00/29538 to Baker et al. describes a non-greasy sacrificial coating containing cellulose or gum and a release aid, such as lecithin. While this coating prevents sticking, its visual appearance makes it unsuitable for glass, countertops, showers and the like.

In view of the deficiencies of past endeavors in developing cleaning compositions that leave satisfactory low maintenance treated surfaces, the art is in search of cleaning compositions that provide a thin, stable invisible film that facilitates removal of a variety of soils. The cleaning composition should be suitable for household surfaces and should be rapidly adsorbed on the surface to yield a uniform film that causes water to sheet off and oil to roll off.

SUMMARY OF THE INVENTION

For the present invention, it has been determined that liquid water plays a critical role in the performance of the cleaning compositions, especially in decreasing the adhesion of soils to surfaces, and that the source of this water can be the atmosphere. The polymer containing cleaning compositions of the present invention can be used not only for modifying surfaces with the goals of making cleaning easier, but also with the goal of providing invisible layers containing water, thereby maintaining or changing the water content of the surface for a variety of uses.

The present invention is based in part on the discovery of that certain polymers can adsorb onto a surface and modify the properties of the surface through the formation of films containing water that is drawn from the ambient atmosphere. Simple water solutions or complex cleaning formulations can be the vehicles by which the polymers are delivered to the surfaces. The very thin films comprising the polymers and atmospheric water are very hydrophilic, resulting in low contact angles of drops of water placed on them. Surprisingly, although the polymers rapidly adsorb water from the atmosphere and produce hydrophilic films, nevertheless, they resist removal from the surface when rinsed with liquid water. These films can therefore be considered to be water-rich polymer gels (polymer gels).

The polymer gels can be used in a variety of ways. The presence of water in the films results in an increase in the interfacial tension and a lowered total energy of adhesion between many common household soils such as soap scum, hydrocarbon greases, or triglyceride greases and the treated surface. The formation of the thin polymer gels interferes with the wetting of the surface by household soils, resulting in much improved, easier cleaning of the surface with subsequent exposure of the surface to liquid water which occurs, for instance, through ordinary rinsing with water, or wiping with a wet towel, cloth, or sponge, but in the absence of any cleaning agents such as surfactants.

Similarly, the surfaces of textiles, woven and non-woven, paper, and related materials can be engineered by the formation of polymer gels so that such items maintain a more constant surface energy, which result from the presence of water in the polymer gels on the surfaces of the fibers. The hydrophilic nature of the polymer gel also reduces the build-up of static charges on surfaces coated therewith. Fibers modified by the presence of the polymer gels can become more receptive to interaction with aqueous solutions or formulations (in the case of wet cleaning wipes) containing pigments, dyes, water-soluble ions, other water-soluble polymers, surfactants, and the like. Conversely, the presence of the polymer gels on the fibers decreases wetting and adhesion of oily or greasy materials such as household soils, non-water soluble dyes, pigments, and/or fragrances onto the fibers.

Finally, the present invention affords a technique to produce extremely thin polymer gels that contain water on targeted surfaces. The polymer gels can be the sites of chemical reactions between materials that occur in water, or in solvents that are miscible with water, thereby localizing the reactants and products within the polymer gels.

DETAILED DESCRIPTION OF THE INVENTION

Hydroscopic polymer gel films of the present invention are preferably developed from aqueous polymer containing compositions that are applied to a surface. The compositions can be formulated as cleaning compositions. Depending on the initial concentration of the polymer in the aqueous composition, water will either evaporate from the composition into the atmosphere or be sequestered into the composition from the ambient environment. The concentration of water will fluctuate with ambient conditions, such as temperature and relative humidity. As used herein, the term "polymer gel" refers to an aqueous mixture containing hydrophilic polymers that will adsorb to surfaces. The polymers can be water soluble or dispersible. No covalent bonds are needed to attach the polymers to the surface. The polymer gel may include other components as described herein.

In general, the aqueous polymer containing composition comprises a water soluble or water dispersible polymer. The hydrophilic polymers preferably are attracted to surfaces and are absorbed thereto without covalent bonds. Examples of suitable polymers include the polymers and co-polymers of N,N dimethyl acrylamide, acrylamide, and certain monomers containing quaternary ammonium groups or amphoteric groups that favor substantivity to surfaces, along with co-monomers that favor adsorption of water, such as, for example, acrylic acid and other acrylate salts, sulfonates, betaines, and ethylene oxides In a preferred embodiment, the composition comprises:

(a) a water soluble or water dispersible copolymer having:
  (i) a first monomer that has a permanent cationic charge or that is capable of forming a cationic charge on protonation;
  (ii) at least one of a second monomer that is acidic and that is capable of forming an anionic charge in the composition hydrophilic group or a third monomer that has an uncharged hydrophilic group; and
  (iii) optionally, a fourth monomer that is hydrophobic;
(b) optionally, a solvent; and
(c) optionally, an adjuvant.

Preferably, the aqueous composition is formulated and applied so that a very thin film of polymer gel that is not visible to the unaided eye eventually develops on the surface. Typically, the polymer gel film has a thickness in the range of 0.5 nm to 500 nm. In a preferred embodiment, the polymer gel films are approximately a monolayer thick, or even less. These layers, even if they are several molecules thick, are not visible to the unaided eye, and hence the appearance of the surfaces modified with them is not altered.

In a preferred embodiment, the proper formulation of the polymer containing aqueous composition allows the initial adsorption of the polymer on the surface and the subsequent uptake of water from the atmosphere to be controlled by thermodynamics rather than to be controlled by the method of applying the composition. This approach is more precise than that of applying a macroscopic film, i.e., visible to the unaided eye, that gradually dissolves upon exposure to water or cleaning solutions. Macroscopic films that are uneven or not completely clear, due to the variations in consumer cleaning habits, change the appearance of cleaned surfaces in a manner less desirable than the present invention. It has been demonstrated that the uptake of water by the thin polymer gel films is favored, spontaneous, and reversible.

A unique feature of the invention is that surfaces that are treated with the inventive compositions release the soil more easily when cleaned with a towel or sponge and water. This increase in the ease of "next time" cleaning is due to the increased amount of water on the surfaces, and the net decreased wetting of the surfaces by greasy soils.

With respect to the synthesis of the water soluble or water dispersible copolymer, the level of the first monomer, which has a permanent cationic charge or that is capable of forming a cationic charge on protonation, is typically between 3 and 80 mol % and preferably 10 to 60 mol % of the copolymer. The level of second monomer, which is an acidic monomer that is capable of forming an anionic charge in the composition, when present is typically between 3 and 80 mol % and preferably 10 to 60 mol % of the copolymer. The level of the third monomer, which has an uncharged hydrophilic group, when present is typically between 3 and 80 mol % and preferably 10 to 60 mol % of the copolymer. When present, the level of uncharged hydrophobic monomer is less than about 50 mol % and preferably less than 10 mol % of the copolymer. The molar ratio of the first monomer to the second monomer typically ranges from 19:1 to 1:10 and preferably ranges from 9:1 to 1:6. The molar ratio of the first monomer to the third monomer is typically ranges from 4:1 to 1:4 and preferably ranges from 2:1 to 1:2.

The average molecular weight of the copolymer typically ranges from about 5,000 to about 10,000,000, with the preferred molecular weight range depending on the polymer composition with the proviso that the molecular weight is selected so that the copolymer is water soluble or water disperible to at least 0.01% by weight in distilled water at 25° C. In preferred embodiments, the copolymer comprises 0.1 to 20%, preferably 0.5 to 10%, and most preferably 1 to 5% of the cleaning composition. (All percentages herein are on a weight basis unless noted otherwise.)

Copolymer

Examples of permanently cationic monomers include, but are not limited to, quaternary ammonium salts of substituted acrylamide, methacrylamide, acrylate and methacrylate, such as trimethylammoniumethylmethacrylate, trimethylammoniumpropylmethacrylamide, trimethylammoniumethylmethacrylate, trimethylammoniumpropylacrylamide, 2-vinyl N-alkyl quaternary pyridinium, 4-vinyl N-alkyl quaternary pyridinium, 4-vinylbenzyltrialkylammonium, 2-vinyl piperidinium, 4-vinyl piperidinium, 3-alkyl 1-vinyl imidazolium, diallyldimethylammonium, and the ionene class of internal cationic monomers as described by D. R. Berger in *Cationic Surfactants, Organic Chemistry*, edited by J. M. Richmond, Marcel Dekker, New York, 1990, ISBN 0-8247-8381-6, which is incorporated herein by reference. This class includes co-poly ethylene imine, co-poly ethoxylated ethylene imine and co-poly quaternized ethoxylated ethylene imine, co-poly [(dimethylimino) trimethylene (dimethylimino) hexamethylene disalt], co-poly [(diethylimino) trimethylene (dimethylimino) trimethylene disalt], co-poly [(dimethylimino) 2-hydroxypropyl salt], co-polyquarternium-2, co-polyquarternium-17, and co-polyquarternium-18, as described in the *International Cosmetic Ingredient Dictionary,* 5th Edition, edited by J. A. Wenninger and G. N. McEwen, which is incorporated herein by reference. Other cationic monomers include those containing cationic sulfonium salts such as co-poly-1-[3-methyl-4-(vinyl-benzyloxy)phenyl] tetrahydrothiophenium chloride. Especially preferred monomers are mono- and di-quaternary derivatives of methacrylamide. The counterion of the cationic co-monomer can be selected from, for example, chloride, bromide, iodide, hydroxide, phosphate, sulfate, hydrosulfate, ethyl sulfate, methyl sulfate, formate, and acetate.

Examples of monomers that are cationic on protonation include, but are not limited to, acrylamide, N,N-dimethylacrylamide, N,N di-isopropylacryalmide, N-vinylimidazole, N-vinylpyrrolidone, ethyleneimine, dimethylaminohydroxypropyl diethylenetriamine, dimethylaminoethylmethacrylate, dimethylaminopropylmethacrylamide, dimethylaminoethylacrylate, dimethylaminopropylacrylamide, 2-vinyl pyridine, 4-vinyl pyridine, 2-vinyl piperidine, 4-vinylpiperidine, vinyl amine, diallylamine, methyldiallylamine, vinyl oxazolidone; vinyl methyoxazolidone, and vinyl caprolactam.

Monomers that are cationic on protonation typically contain a positive charge over a portion of the pH range of 2–11. Such suitable monomers are also presented in *Water-Soluble Synthetic Polymers: Properties and Behavior*, Volume II, by P. Molyneux, CRC Press, Boca Raton, 1983, ISBN 0-8493-6136. Additional monomers can be found in the *International Cosmetic Ingredient Dictionary,* 5th Edition, edited by J. A. Wenninger and G. N. McEwen, The Cosmetic, Toiletry, and Fragrance Association, Washington D.C., 1993, ISBN 1-882621-06-9. A third source of such monomers can be found in *Encyclopedia of Polymers and Thickeners for Cosmetics*, by R. Y. Lochhead and W. R. Fron, Cosmetics & Toiletries, vol. 108, May 1993, pp 95–135. All three references are incorporated herein.

Examples of acidic monomers that are capable of forming an anionic charge in the composition include, but are not limited to, acrylic acid, methacrylic acid, ethacrylic acid, dimethylacrylic acid, maleic anhydride, succinic anhydride, vinylsulfonate, cyanoacrylic acid, methylenemalonic acid, vinylacetic acid, allylacetic acid, ethylidineacetic acid, propylidineacetic acid, crotonic acid, fumaric acid, itaconic acid, sorbic acid, angelic acid, cinnamic acid, styrylacrylic acid, citraconic acid, glutaconic acid, aconitic acid, phenylacrylic acid, acryloxypropionic acid, citraconic acid, vinylbenzoic acid, N-vinylsuccinamidic acid, mesaconic acid, methacroylalanine, acryloylhydroxyglycine, sulfoethyl methacrylate, sulfopropyl acrylate, and sulfoethyl acrylate. Preferred acid monomers also include styrenesulfonic acid, 2-methacryloyloxymethane-1-sulfonic acid, 3-methacryloyloxypropane-1-sulfonic acid, 3-(vinyloxy) propane-1-sulfonic acid, ethylenesulfonic acid, vinyl sulfuric acid, 4-vinylphenyl sulfuric acid, ethylene phosphonic acid and vinyl phosphoric acid. Most preferred monomers include acrylic acid, methacrylic acid and maleic acid. The copolymers useful in this invention may contain the above acidic monomers and the alkali metal, alkaline earth metal, and ammonium salts thereof.

Examples of monomers having an uncharged hydrophilic group include but are not limited to vinyl alcohol, vinyl acetate, vinyl methyl ether, vinyl ethyl ether, ethylene oxide and propylene oxide. Especially preferred are hydrophilic esters of monomers, such as hydroxyalkyl acrylate esters, alcohol ethoxylate esters, alkylpolyglycoside esters, and polyethylene glycol esters of acrylic and methacrylic acid.

Finally, examples of uncharged hydrophobic monomers include, but are not limited to, $C_1$–$C_4$ alkyl esters of acrylic acid and of methacrylic acid.

The copolymers are formed by copolymerizing the desired monomers. Conventional polymerization techniques can be employed. Illustrative techniques include, for example, solution, suspension, dispersion, or emulsion polymerization. A preferred method of preparation is by precipitation or inverse suspension polymerization of the copolymer from a polymerization media in which the monomers are dispersed in a suitable solvent. The monomers employed in preparing the copolymer are preferably water soluble and sufficiently soluble in the polymerization media to form a homogeneous solution. They readily undergo polymerization to form polymers which are water-dispersable or water-soluble. The preferred copolymers contain acrylamide, methacrylamide and substituted acrylamides and methacrylamides, acrylic and methacrylic acid and esters thereof. Suitable synthetic methods for these copolymers are described, for example, in Kirk-Othmer, *Encyclopedia of Chemical Technology*, Volume 1, Fourth Ed., John Wiley & Sons.

Aqueous Carrier

The compositions of the present invention preferably comprise an aqueous liquid carrier that includes water and optionally one or more organic solvents. Water typically comprises from about 50% to 100%, preferably from about 60% to about 98%, and more preferably from about 80% to about 96% of the aqueous carrier, with the optional solvent forming the balance. Deionized or softened water is preferred.

In preferred low-surfactant compositions for use in no-rinse cleaning, the aqueous carrier typically comprise about 98% to about 99.99%, preferably from about 99% to about 99.99%, and more preferably from about 99.5% to about 99.99%, of the compositions.

The solvent is typically used to dissolve various components in the improved cleaning composition so as to form a substantially uniformly dispersed mixture. The solvent can also function as (i) a cleaning agent to loosen and solubilize greasy or oily soils from surfaces, (ii) a residue inhibiting agent to reduce residues left behind on a cleaned surface, (iii) a detergent agent, and /or (iv) a disinfecting, sanitizing, and/or sterilizing agent.

The solvent, when used, can be premixed with the other components of the cleaning composition or be partially or fully added to the improved cleaning composition prior to use. The solvent may be water soluble and/or it is a water dispersable organic solvent. The solvent can be selected to have the desired volatility depending on the cleaning application.

Suitable solvents include, but are not limited to, $C_{1-6}$ alkanols, $C_{1-6}$ diols, $C_{1-10}$ alkyl ethers of alkylene glycols, $C_{3-24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. Diols include, but are not limited to, methylene, ethylene, propylene and butylene glycols. Alkylene glycol ethers include, but are not limited to, ethylene glycol monopropyl ether, ethylene glycol monobutyl ether, propylene glycol n-propyl ether, propylene glycol monobutyl ether, propylene glycol t-butyl ether, diethylene glycol monoethyl or monopropyl or monobutyl ether, di- or tri-polypropylene glycol methyl or ethyl or propyl or butyl ether, acetate and propionate esters of glycol ethers. Short chain carboxylic acids include, but are not limited to, acetic acid, glycolic acid, lactic acid and propionic acid. Short chain esters include, but are not limited to, glycol acetate, and cyclic or linear volatile methylsiloxanes. Water insoluble solvents such as isoparafinic hydrocarbons, mineral spirits, alkylaromatics, terpenoids, terpenoid derivatives, terpenes, and terpene derivatives can be mixed with a water soluble solvent when employed.

When water insoluble solvents are mixed with a water soluble solvent for the cleaning composition, the amount of the water insoluble solvent in the cleaning composition is generally less than about 10% typically less than about 5% and more typically less than about 1% of the cleaning composition. Typically the solvent should range from 0.01% to 10%. As can be appreciated, the cleaning composition can be a non-aqueous cleaner wherein little, if any, water is used. In such formulations, amount of the water insoluble solvent can be greater than about 10%.

Suitable water insoluble solvent includes, but is not limited to, tertiary alcohols, hydrocarbons (e.g. alkanes), pine-oil, terpinoids, turpentine, turpentine derivatives, terpenoid derivatives, terpinolenes, limonenes, pinenes, terpene derivatives, benzyl alcohols, phenols, and their homologues. Certain terpene derivatives that can be used include, but are not limited to, d-limonene, and dipentene. Pyrrolidones include, but are not limited to, N-methyl-2-pyrrolidone, N-octyl-2-pyrrolidone and N-dodecyl-2-pyrrolidone. In one particular formulation of the cleaning composition, the solvents can include, but are not limited to, n-propanol, isopropanol, butanol, ethyleneglycol butylether, diethyleneglycol butylether, propyleneglycol butylether, dipropyleneglycol butylether, and/or hexyl cellusolve. In another particular preferred formulation, the solvent includes isopropanol and/or propyleneglycol butylether.

Typically, the cleaning composition includes at least about 0.5% solvent to avoid solubility problems which can result from the combination of various components of the cleaning composition. The amount of the solvent in the cleaning composition may exceed about 70% when formulated as a concentrate.

Surfactant

The cleaning composition may include an effective amount of surfactant for (i) improving the cleaning performance (e.g., by improving wetting properties), (ii) stabilizing cleaning composition, and (iii) emulsifying the cleaning components. Conventional nonionic, anionic, cationic, zwitterionic, and/or amphoteric surfactants can be employed. Suitable surfactants are described in *McCutcheon's Emulsifiers and Detergents* (1997), Kirk-Othmer, Encyclopedia of Chemical Technology, 3rd Ed., Volume 22, pp. 332–432 (Marcel-Dekker, 1983), and *McCutcheon's Soaps and Detergents* (N. Amer. 1984), which are incorporated herein by reference.

Suitable surfactant includes, but is not limited to, glycoside, glycols, ethylene oxide and mixed ethylene oxide/propylene oxide adducts of alkylphenols and alcohols, the ethylene oxide and mixed ethylene oxide/propylene oxide adducts of long chain alcohols or of fatty acids, mixed ethylene oxide/propylene oxide block copolymers, esters of fatty acids and hydrophilic alcohols, sorbitan monooleates, alkanolamides, soaps, alkylbenzene sulfonates, olefin sulfonates, paraffin sulfonates, propionic acid derivatives, alcohol and alcohol ether sulfates, phosphate esters, amines, amine oxides, alkyl sulfates, alkyl ether sulfates, sarcosinates, sulfoacetates, sulfosuccinates, cocoamphocarboxy glycinate, salts of higher acyl esters of isethionic acid, salts of higher acyl derivatives of taurine or methyltaurine, phenol poly ether sulfates, higher acyl derivatives of glycine and methylglycine, alkyl aryl polyether alcohols, salts of higher alkyl substituted imadazolinium dicarboxylic acids, tannics, naphthosulfonates, monochloracetics anthraflavinics, hippurics, anthranilics, naphthoics, phthalics, carboxylic acid salts, acrylic acids, phosphates, alkylamine ethoxylates, ethylenediamine alkoxylates, betaines, sulfobetaines, and imidazolines.

Lauryl sulfate, laurylether sulfate, cocamidopropylbetaine, alkyl polyglycosides, and amine oxides can also be employed as surfactants. The amine oxides can be ethoxylated and/or propoxylated. One specific amine oxide includes, but is not limited to, alkyl di (hydroxy lower alkyl) amine oxides, alkylamidopropyl di (lower alkyl) amine oxides, alkyl di (lower alkyl) amine oxides, and/or alkylmorpholine oxides, wherein the alkyl group has 5–25 carbons and can be branched, unbranched, saturated, and/or unsaturated. Nonlimiting examples of amine oxides include, but are not limited to, lauryldimethylamine oxide sold under the name BARLOX 12 from Lonza.

The alkyl polyglycosides are typically formed by reacting a sugar with a higher alcohol in the presence of an acid catalyst, or by reacting a sugar with a lower alcohol (for example, methanol, ethanol, propanol, butanol) to thereby provide a lower alkyl glycoside, which is then reacted with a higher alcohol. The higher alcohol generally has the formulation $R_1O(R_2O)_xH$, wherein $R_1$ represents a straight or branched alkyl, alkenyl, or alkylphenyl group having from 2 to 30 carbon atoms, $R_2$ represents an alkylene group having from 2 to 20 carbon atoms, and X is a mean value that is 0 to 10. Specific nonlimiting examples of the higher alcohol are straight or branched alkanol such as hexanol, heptanol, octanol, nonanol, decanol, dodecanol, tridecanol, tetradecanol, pentadecanol, hexadecanol, heptadecanol, octadecanol, methylpentanol, methylhexanol, methylheptanol, methyloctanol, methyldecanol, methylundecanol, methyltridecanol, methylheptadecanol, ethylhexanol, ethyloctanol, ethyldecanol, ethyldodecanol, 2-heptanol, 2-nonanol, 2-undecanol, 2-tridecanol, 2-pentadecanol, 2-heptadecanol, 2-butyloctanol, 2-hexyloctanol, 2-octyloctanol, 2-hexyldecanol and/or 2-octyldecanol; an alkenol such as hexenol, heptenol, octenol, nonenol, decenol, undecenol, dodecenol, tridecenol, tetradecenol, pentadecenol, hexadecenol, heptadecenol and octadecenol, and alkylphenols such as octylphenol and nonylphenol. These alcohols or alkylphenols may be used either alone or a mixture of two or more of them.

Further, an alkylene oxide adduct of these alcohols or alkylphenols can be used. The sugar used to form the alkyl glycoside includes, but is not limited to, monosaccharides, oligosaccharides, and polysaccharides. Nonlimiting examples of the monosaccharides include aldoses such as, but not limited to, allose, altrose, glucose, mannose, gulose, idose, galactose, talose, ribose, arabinose, xylose, and lyxose. Nonlimiting examples of the oligosaccharides include maltose, lactose, sucrose and maltotriose. Nonlimiting examples of the polysaccharides include hemicellulose, insulin, dextrin, dextran, xylan, starch and/or hydrolyzed starch. Specific alkyl glycosides that can be used are represented by the following formula: $D_1O(D_2O)_xH_y$ wherein $D_1$ is an alkyl, alkenyl, or alkylphenyl group having from 6 to 30 carbon atoms, $D_2$ is an alkylene group having from 2 to 20 carbon atoms, H is a residual group originating from a reducing sugar having 2 or 10 carbon atoms, X is a mean value that is 0 to 10, and Y is a mean value that is 1 to 10. Nonlimiting examples of alkyl polyglycosides include, but are not limited to, APG series alkyl polyglycosides from Cognis.

Surfactants may also include ethoxylated alcohols having an alkyl group typically with 6–22 carbons; the alkyl group is preferably linear but could be branched. Furthermore, the carbon groups can be saturated or unsaturated. Suitable ethoxylated alcohols include the SURFONIC L series surfactants by Huntsman. Fluorosurfactants can also be used as the surfactant. A suitable fluorosurfactant is an ethoxylated noninoic fluorosurfactant. Suitable ethoxylated noninoic fluorosurfactants include the ZONYL surfactants by DuPont.

Typically the surfactant is partially or fully soluble in water. When employed, the surfactant comprises at least about 0.001% and typically 0.01–10% of the cleaning composition. The amount of surfactant may exceed 10% when the cleaning composition is formulated in concentrate. Preferably, the surfactant content is about 0.1–2%.

Antimicrobial Agent

An antimicrobial agent can also be included in the cleaning composition. Non-limiting examples of useful quaternary compounds that function as antimicrobial agents include benzalkonium chlorides and/or substituted benzalkonium chlorides, di($C_6$–$C_{14}$)alkyl di short chain (($C_{1-4}$ alkyl and/or hydroxyalkl) quaternaryammonium salts, N-(3-chloroallyl) hexaminium chlorides, benzethonium chloride, methylbenzethonium chloride, and cetylpyridinium chloride. The quaternary compounds useful as cationic antimicrobial actives are preferably selected from the group consisting of dialkyldimethyl ammonium chlorides, alkyldimethylbenzylammonium chlorides, dialkylmethylbenzylammonium chlorides, and mixtures thereof. Biguanide antimicrobial actives including, but not limited to polyhexamethylene biguanide hydrochloride, p-chlorophenyl biguanide; 4-chlorobenzhydryl biguanide, halogenated hexidine such as, but not limited to, chlorhexidine (1,1'-hexamethylene-bis-5-(4-chlorophenyl biguanide) and its salts are especially preferred. Typical concentrations for biocidal effectiveness of these quaternary compounds, especially in the preferred low-surfactant compositions herein, range from about 0.001% to about 0.8% and preferably from about 0.005% to about 0.3% of the usage composition. The weight percentage ranges for the biguanide and/or quat compounds in the cleaning composition is selected to disinfect, sanitize, and/or sterilize most common household and industrial surfaces.

Non-quaternary biocides are also useful in the present compositions. Such biocides can include, but are not limited to, alcohols, peroxides, boric acid and borates, chlorinated hydrocarbons, organometallics, halogen-releasing compounds, mercury compounds, metallic salts, pine oil, organic sulfur compounds, iodine compounds, silver nitrate, quaternary phosphate compounds, and phenolics.

Preferred antimicrobial agents also include organic acids, such as, acetic, lactic, sulfamic and glycolic acids.

Builder/Buffer

The cleaning composition may include a builder detergent which increase the effectiveness of the surfactant. The builder detergent can also function as a softener and/or a sequestering and buffering agent in the cleaning composition. A variety of builder detergents can be used and they include, but are not limited to, phosphate-silicate compounds, zeolites, alkali metal, ammonium and substituted ammonium polyacetates, trialkali salts of nitrilotriacetic acid, carboxylates, polycarboxylates, carbonates, bicarbonates, polyphosphates, aminopolycarboxylates, polyhydroxysulfonates, and starch derivatives.

Builder detergents can also include polyacetates and polycarboxylates. The polyacetate and polycarboxylate compounds include, but are not limited to, sodium, potassium, lithium, ammonium, and substituted ammonium salts of ethylenediamine tetraacetic acid, ethylenediamine triacetic acid, ethylenediamine tetrapropionic acid, diethylenetriamine pentaacetic acid, nitrilotriacetic acid, oxydisuccinic acid, iminodisuccinic acid, mellitic acid, polyacrylic acid or polymethacrylic acid and copolymers, benzene polycarboxylic acids, gluconic acid, sulfamic acid, oxalic acid, phosphoric acid, phosphonic acid, organic phosphonic acids, acetic acid, and citric acid. These builder detergents can also exist either partially or totally in the hydrogen ion form.

The builder agent can include sodium and/or potassium salts of EDTA and substituted ammonium salts. The substituted ammonium salts include, but are not limited to, ammonium salts of methylamine, dimethylamine, butylamine, butylenediamine, propylamine, triethylamine, trimethylamine, monoethanolamine, diethanolamine, triethanolamine, isopropanolamine, ethylenediamine tetraacetic acid and propanolamine.

Buffering and pH adjusting agents, when used, include, but are not limited to, organic acids, mineral acids, alkali metal and alkaline earth salts of silicate, metasilicate, polysilicate, borate, carbonate, carbamate, phosphate, polyphosphate, pyrophosphates, triphosphates, tetraphosphates, ammonia, hydroxide, monoethanolamine, monopropanolamine, diethanolamine, dipropanolamine, triethanolamine, and 2-amino-2methylpropanol. Preferred buffering agents for compositions of this invention are nitrogen-containing materials. Some examples are amino acids such as lysine or lower alcohol amines like mono-, di-, and tri-ethanolamine. Other preferred nitrogen-containing buffering agents are tri(hydroxymethyl) amino methane $(HOCH_2)_3CNH_3$ (TRIS), 2-amino-2-ethyl-1,3-propanediol, 2-amino-2-methyl-propanol, 2-amino-2-methyl-1,3-propanol, disodium glutamate, N-methyl diethanolarnide, 2-dimethylamino-2-methylpropanol (DMAMP), 1,3-bis (methylamine)-cyclohexane, 1,3-diamino-propanol N,N'-tetra-methyl-1,3-diamino-2-propanol, N,N-bis(2-hydroxyethyl)glycine (bicine) and N-tris(hydroxymethyl) methyl glycine (tricine). Other suitable buffers include ammonium carbarnate, citric acid, acetic acid. Mixtures of any of the above are also acceptable. Useful inorganic buffers/alkalinity sources include ammonia, the alkali metal carbonates and alkali metal phosphates, e.g., sodium carbonate, sodium polyphosphate. For additional buffers see *McCutcheon's Emulsifiers and Detergents*, North American Edition, 1997, McCutcheon Division, MC Publishing Company Kirk and WO 95/07971 both of which are incorporated herein by reference.

When employed, the builder detergent comprises at least about 0.001% and typically about 0.01–5% of the cleaning composition. The amount of the builder detergent may exceed about 5% when the cleaning composition is formulated as a concentrate. Preferably, the builder detergent content is about 0.01–2%.

Additional Adjuvants

The cleaning composition may includes additional adjuncts. The adjuncts include, but are not limited to, fragrances or perfumes, waxes, dyes and/or colorants, solubilizing materials, stabilizers, thickeners, defoamers, hydrotropes, lotions and/or mineral oils, enzymes, bleaching agents, cloud point modifiers, preservatives, and other polymers. The waxes, when used, include, but are not limited to, carnauba, beeswax, spermacet, candelilla, paraffin, lanolin, shellac, esparto, ouricuri, polyethylene wax, chlorinated naphthaline wax, petrolatu, microcrystalline wax, ceresine wax, ozokerite wax, and/or rezowax. The solubilizing materials, when used, include, but are not limited to, hydrotropes (e.g. water soluble salts of low molecular weight organic acids such as the sodium and/or potassium salts of xylene sulfonic acid). The acids, when used, include, but are not limited to, organic hydroxy acids, citric acids, keto acid, and the like. Thickeners, when used, include, but are not limited to, polyacrylic acid, xanthan gum, calcium carbonate, aluminum oxide, alginates, guar gum, methyl, ethyl, clays, and/or propylhydroxycelluloses. Defoamers, when used, include, but are not limited to, silicones, aminosilicones, silicone blends, and/or silicone/hydrocarbon blends. Lotions, when used, include, but are not limited to, achlorophene and/or lanolin. Enzymes, when used, include, but are not limited to, lipases and proteases, and/or hydrotropes such as xylene sulfonates and/or toluene sulfonates. Bleaching agents, when used, include, but are not limited to, peracids, hypohalite sources, hydrogen peroxide, and/or sources of hydrogen peroxide.

Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. Dantogard and Dantogard Plus both from Lonza, Inc. and/or Glydant) and/or short chain alcohols (e.g. ethanol and/or IPA).

The mildewstat or bacteriostat includes, but is not limited to, mildewstats (including non-isothiazolone compounds) include Kathon GC, a 5-chloro-2-methyl-4-isothiazolin-3-one, KATHON ICP, a 2-methyl-4-isothiazolin-3-one, and a blend thereof, and KATHON 886, a 5-chloro-2-methyl-4-isothiazolin-3-one, all available from Rohm and Haas Company; BRONOPOL, a 2-bromo-2-nitropropane 1,3 diol, from Boots Company Ltd., PROXEL CRL, a propyl-p-hydroxybenzoate, from ICI PLC; NIPASOL M, an o-phenylphenol, $Na^+$ salt, from Nipa Laboratories Ltd., DOWICIDE A, a 1,2-Benzoisothiazolin-3-one, from Dow Chemical Co., and IRGASAN DP 200, a 2,4,4'-trichloro-2-hydroxydiphenylether, from Ciba-Geigy A.G.

Absorbent Materials

The cleaning composition of the present invention can be used independently from or in conjunction with an absorbent and/or adsorbent material. For instance, the cleaning composition can be formulated to be used in conjunction with a cleaning wipe, sponge (cellulose, synthetic, etc.), paper towel, napkin, cloth, towel, rag, mop head, squeegee, and/or other cleaning device that includes an absorbent and/or adsorbent material.

The cleaning wipe can be made of nonwoven material such as nonwoven, fibrous sheet materials or meltblown, coform, air-laid, spun bond, wet laid, bonded-carded web materials, and/or hydroentangled (also known as spunlaced) materials. The cleaning wipe can also be made of woven materials such as cotton fibers, cotton/nylon blends and/or other textiles. The cleaning wipe can also include wood pulp, a blend of wood pulp, and/or synthetic fibers, e.g., polyester, rayon, nylon, polypropylene, polyethylene, and/or cellulose polymers.

The absorbent material can be constructed as part of a single or multiple layer cleaning pad attached in either the wet or dry state to the end of a mop. The cleaning pads will preferably have an absorbent capacity, when measured under a confining pressure of 0.09 psi after 20 minutes, of at least about 1 g deionized water per g of the cleaning pad, preferably at least about 10 g deionized water per g of the cleaning pad.

When the cleaning formulation is incorporated in an absorbent material, the cleaning composition may include an effective amount of release agent to increase the amount of polymer released from the cleaning wipe onto a surface. The release agent is preferably an ionic species designed to compete with the polymer for sites on the cleaning wipe thereby causing increased polymer release from the cleaning wipe during use of the cleaning wipe. The release agent may include a salt. A variety of different salts can be used such as, but not limited to, monovalent salts, divalent salts, organic salts, and the like. Preferably, the effective ionic strength of the release agent in the cleaning composition is at least about $5\times10^{-3}$ mol/l.

Treating Textile Surfaces

The inventive compositions can be applied to textiles to modify their surfaces to render them hydrophilic and more receptive to interactions with aqueous solutions or formulations. The textiles can be either woven or non-woven; the materials can be natural, e.g., cotton, or synthetic, e.g., polyester. The specific fabric is not critical.

Treating Hard Surfaces

The inventive compositions can be also applied to hard materials to modify their surfaces to render them hydrophilic and thereby exhibit improved "next time cleaning." Hard surface include those made from metal, plastic, stone both natural and synthetic, e.g., CORIAN, glass, ceramic, and the like. These are commonly found among household fixtures including, for example, tiles, bathtubs, and towel bowel, kitchen countertops, floors, and windows. In addition, the compositions can be used on the interior and exterior surfaces of cars, boats, and other vehicles, including the finished and painted surfaces thereof.

Reactive Materials

Polymer gels can be applied to selected surface areas in order to create localized reaction sites. For example, a polymer gel that includes a first reactant material and that is formed on a region on a surface may subsequently be exposed to a second reactant material to create a chemical reactant. The choice of the reactants is not critical although they should preferably be water soluble or water dispersible. For example, a first reactant may be phenolphthalein and a second reactant may be sodium hydroxide. Other reactant pairs include: (i) an ester of a fatty acid and sodium hydroxide and commercially available enzyme such as savinase or lipase and substrate such as a greasy or starchy soil.

The following examples illustrate the cleaning compositions of the invention. The examples are for illustrative purposes only and are not meant to limit the scope of the invention in any way.

EXAMPLES

Various formulations of the inventive cleaning composition were prepared and tested with respect to a number of characteristics, including the following: (i) water contact angle, (ii) resistance of surface modification to water treatment, (iii) film thickness, (iv) water drainage, (v) soil build-up prevention and (vi) soil cleaning performance.

Water Contact Angle

It is desirable that treated surfaces be modified with respect to water based soils. θ (water) is the contact angle of the water on a surface. Small θ (water) means that the water drops will spread readily on the surface, giving a thin film that readily drains from the surface. The contact angle of water on enamel (i.e., vitreous protective coating on appliances) surfaces that were treated with the cleaning formulations is a direct measure of the modification of the surface energy. The adsorption of the copolymers, even at thicknesses less than monolayer, decreases the contact angle of water, i.e., the wetting of the surface by water alone is drastically improved. This benefit is evident even after rinsing of the surfaces with water, because of the thermodynamically favored adsorption of the polymers. The contact angle data in Table 1 show the extended benefits provided by these formulations as compared to formulations without the copolymer and a competitive product. The aqueous cleaning formulation contained:

| | |
|---|---|
| Berol 226 (surfactant from AKZO Chemie) | 1.0% |
| Ethyleneglycol n-butylether | 3.0% |
| Mono-ethanolamine | 0.5% |
| Tetrapotassium ethylenediaminetetraacetic acid | 0.44% |
| Alkyldimethylbenzylammonium chloride | 0.3% |
| Copolymer of di-quarternaryamide of methacrylic acid and acrylic acid | 0.25% |

Drops of the same volume of water were placed on multiple spots of enamel coupons. The contact angles, in degrees, were measured manually with a Rame-Hart Goniometer, after cleaning the coupon with the formulation, and after rinsing the coupon with 10 sprays of tap water delivered from the same trigger sprayer. The inventive cleaning composition, even after water sprays, gives a water contact angle less than about 10 degrees and spreading.

TABLE 1

| Composition | θ (water) initial | θ (water) 10 Sprays |
|---|---|---|
| Untreated Surface | 33 | 37 |
| Cleaning formulation (no polymer) | 6 | 36 |
| Cleaning formulation (polymer) | 5 | 6 |
| Commercial cleaning formulation | 28 | 38 |

The inventive compositions also provide lower water contact angles even in the presence of hydrophobic soap scum soils. Glossy black tile coupons (4"×4") were pretreated with cleaning formulations by spraying 4 sprays of the product, allowing to sit 3 minutes, followed by 2 sprays rinsing with 300 ppm 3:1 Ca/Mg hard water and allowed to dry. The pretreatment was repeated a second time prior to soiling. Once pretreated, the coupons were then soiled with 4 sprays 300 ppm 3:1 Ca/Mg hard water followed by 2 sprays 0.05% soap scum/sebum oil solution and allowed to dry vertically. The soiling was repeated ten times. The water contact angles were measured as above and are shown in Table 2. The results show that the cleaning formulation with polymer gives a relatively hydrophilic surface with water spreading, while the surfaces treated without polymer or with a commercial formulation have every hydrophobic surfaces that attract soils.

The cleaning formulation comprised: sulfamic acid 3.5%, glycolic acid 1.5%, Dowfax 2A 1 (anionic) 1.25%, dipropylenegylcol n-butylether 2.5%, propyleneglycol n-propylether 1.5%, alkylpolyglycoside 0.5%, KOH to pH2, fragrance, and copolymer of N,N-dimethylacrylamide and acrylic acid 0.1%.

TABLE 2

| Composition | θ (water) after 10 cycles of soap scum treatment |
|---|---|
| Cleaning formulation (no polymer) | 46 |
| Cleaning formulation (polymer) | 29 |
| Commercial cleaning formulation | 48 |

Resistance of Surface Modification to Water Treatment

The inventive copolymers and formulations are particularly useful because of their continued surface modification properties after extended contact with water. This attribute can be measured by the copolymer's resistance to desorption in the presence of water. The ability of the copolymers to remain on a surface, even after repeated exposure of the surface to water was assessed with Fourier Transform Infrared (FT-IR).

FT-IR spectroscopic analysis of hard surfaces can be used successfully to monitor the adsorption and desorption of surfactants and copolymers.

One FT-IR technique is to employ an optical accessory that utilizes the principle of attenuated total reflectance (ATR). In ATR experiments, the infrared radiation is transmitted through an internal reflection element (IRE). Any material that is in intimate contact with the IRE will be able to interact with the infrared radiation and generates an infrared spectrum of the material. The amount of absorbance of the infrared radiation, and hence the intensity of the absorption bands that appear in the spectrum, are directly proportional to the amount of an infrared absorbing material and the pathlength of the infrared radiation through the sample. The relative amounts of surfactant and copolymer that adsorb onto an IRE subjected to various treatments with the inventive cleaning formulations were monitored using FT-IR with ATR optical accessories from Harrick Scientific (Ossining, N.Y.). The IREs were made from germanium, which is an infrared transparent material that, when clean, has a "moderate" surface energy that is similar to many common household surfaces, such as glass, porcelain, ceramic tile, steel, and aluminum. The analysis of the very small amounts of copolymer adsorbed on the surface of the IRE is routine and the relative intensities of the infrared absorption bands in the spectra can be used to distinguish the presence of a monolayer, and even a patchy, partial monolayer of a copolymer from a layer that is many thousands of molecules thick. FT-IR spectroscopy is described in *Fourier Transform Infrared Spectrometry*, by P. R. Griffiths. ATR optical accessories are decsribed in *Internal Reflection Spectroscopy*, By N. J. Harrick, Interscience Publishers, 1967, and *Internal Reflection Spectroscopy Review and Supplement*, by F. M. Mirabella Jr., N. J. Harrick, Editor, Harrick Scientific Corporation, 88 Broadway, Box 1288, Ossining, N.Y. 10562.

A known amount of copolymer solution or cleaning formulation containing a known amount of copolymer was applied to a germanium IRE (total surface area exposed to product=3.75 $cm^2$) and allowed to dry. The IRE was then immersed in deionized water for different lengths of time to simulate exposure of a household surface such as a shower enclosure to typical consumer use. After immersion in water, the IRE was dried and the spectrum of the residue still adsorbed on it was recorded. A visual inspection of the IRE, which appears smooth and mirror-like, was done after each water exposure to determine if a film or residue could be seen by the human eye.

In one set of experiments, fifty microliters of a copolymer solution was applied to the IRE surface, dried and a spectrum obtained. The solution comprised 0.15% copolymer of di-quarternaryamide of methacrylic acid and acrylic acid in:

| | |
|---|---|
| Berol 226 (surfactant from AKZO Chemie) | 0.8% |
| Alkylpolyglycoside | 0.5% |
| Ethyleneglycol n-butylether | 3.0% |
| Mono-ethanolamine | 0.5% |
| Tetrapotassium ethylenediaminetetraacetic acid | 0.44% |
| Alkyldimethylbenzylammonium chloride | 0.3% |

This treatment yielded a surface initially bearing 0.075 micrograms total or 0.020 micrograms/cm$^2$. Table 3 below shows the intensities of the absorption band in the FT-IR spectra as a function of the total time of immersion of the sample in water. The absorption band chosen appeared in the FT-IR spectra at approximately 1482 wavenumbers cm. As is apparent, the copolymer is still present on the surface even after 30 minutes of immersion and that the copolymer decreases the polymer concentration by only 11% compared to 1 minute immersion and 4% compared to 5 minute immersion. The very low level of polymer on the surface is believed to be a monolayer or even less, but this level of copolymer is still sufficient to impart hydrophilic properties to the surface, such as small water contact angles, and water sheeting.

TABLE 3

| Water Immersion time, minutes | Absorbance intensity @ 1482 cm$^{-1}$ | Surface Properties |
|---|---|---|
| 1 | 0.00193 | No film visible Hydrophilic |
| 5 | 0.00179 | No film visible Hydrophilic |
| 30 | 0.00171 | No film visible Hydrophilic |

In another set of experiments, fifty microliters of the same cleaning formulation was applied to the IRE surface, dried and a spectrum obtained. The IRE was immersed in water, dried, and a spectrum of the residue on the surface was obtained for different immersion times. After 5 minutes of total immersion time, the FT-IR spectrum obtained closely resembled that obtained in the previous example, indicating that most of the other formulation components had been removed from the surface, and that a layer of the inventive copolymer of approximately a monolayer thickness or less was still present on the surface. The absorbance intensity of a band in the FT-IR spectrum at 1100 cm$^{-1}$ that can be assigned to the ethylene oxide groups of the surfactant cleaners in the formulation is shown in Table 4. The rapid loss of the surfactants from the surface is consistent with the large decrease in the intensity of this band. The spectrum indicates that the polymer concentration only decreases 27% from 5 minutes to 30 minutes immersion, while the surfactant portion decreases 83%. This level of polymer is still sufficient to impart hydrophilic properties to the surface, such as small water contact angles, and water sheeting.

TABLE 4

| Water Immersion time, minutes | Absorbance intensity @ 1482 cm$^{-1}$ | Absorbance intensity @ 1100 cm$^{-1}$ | Surface Properties |
|---|---|---|---|
| 5 | 0.002134 | 0.001387 | No film visible Hydrophilic |
| 30 | 0.001348 | 0.000361 | No film visible Hydrophilic |

Film Thickness

There are several possible approaches to changing the surface energy in order to deliver a "next time easier cleaning" benefit. One approach is the application of a macroscopic film (visible to the human eye) to the surface that gradually dissolves upon exposure to water or aqueous cleaning solutions, thereby carrying dirt away. One disadvantage of this approach is the "unevenness" of the film which is caused by variation in consumer cleaning habits. The clarity and evenness of a film deposited on, for example, glass shower doors, or reflective metal stovetops, should be very good but this is very difficult to achieve in practice with a macroscopic film.

A more precise way to generate an easier next cleaning benefit is through the delivery of a molecule or mixture of molecules (typically copolymeric materials) from a cleaning formulation that is adsorbed on the surface, at approximately a monolayer level of coverage. This layer, even if it is several molecules thick, is not visible to the eye, and hence does not significantly change the appearance of the surface. Proper selection of copolymer and cleaning composition allows the adsorption of the copolymer on a given substrate to be controlled spontaneously and reproducibly by thermodynamics rather than by the method of applying the composition.

FT-IR was used to measure the amount of inventive copolymer that adsorbed onto a Ge IRE from aqueous solutions containing various amounts of the copolymer. There was no drying step in these experiments. The IRE was covered by a solution containing the copolymer for 5 minutes. After this step, the copolymer solution was removed and rinsed three times by applying deionized water and quickly removing it. The total exposure time of the adsorbed copolymer layer to the rinse water was less than 1 minute in all cases, in an attempt to minimize the amount of desorption that occurred. The concentration of the copolymer in the solutions was varied from 0.125% to 2.5%. A calibration curve was created to correlate film thickness to absorbance intensity. The results in Table 5 show that significant adsorption occurs rapidly, even at the lowest concentration, which is due to the thermodynamically favored adsorption of the polymer on the surface. The FT-IR spectra of all of the layers exhibited all the major absorption bands due to the copolymer.

TABLE 5

| Polymer concentration, weight % | Absorbance intensity @ 1495 cm$^{-1}$ | Polymer layer thickness, nanometers |
|---|---|---|
| 0.125 | 0.000231 | 0.18 |
| 0.125 | 0.000217 | 0.16 |
| 0.250 | 0.000403 | 0.35 |
| 0.250 | 0.000413 | 0.36 |
| 2.50 | 0.000638 | 0.53 |
| 2.50 | 0.000578 | 0.48 |

Copolymer of N,N-dimethylacrylamide and acrylic acid (327,000 MW)

Water Drainage

Water drainage is a good measure of continued modification of a treated surface. The process of draining water off hard surfaces was measured by weighing the water remaining after water is sprayed on treated/cleaned surfaces. Testing is conducted on a 12×12 in. mirror panel. Initially, mirror surfaces are wiped with 2.5 g of cleaner on a paper towel and wiped dry. The cleaned, pretreated mirror is weighed and the mirror is then placed at a 52-degree angle. A 300 ppm Ca:Mg (3:1) hardwater solution is prepared and poured in a spray trigger bottle to apply 10 sprays on the mirror. The mirror is allowed to dry and the water spray is repeated for a second rinse. After draining 10 minutes, the mirror is placed on a balance to weight the mirror plus water on surface. Water remaining on the surface is obtained by subtracting the final weight of the mirror plus water minus the initial weight of the treated mirror. The mirror that has the lowest amount of water has the fastest/better drainage. The rinse can be repeated a third time after the mirrors dry. The composition A, whose formulation is listed in Table 6, was tested against the commercial formula, FANTASTIK all purpose cleaner from SC Johnson, and the results are given in Table 7 in g of water left per square foot of mirror. The results indicate that the inventive composition allows water to sheet off, even after the third rinse.

TABLE 6

| Composition A | |
|---|---|
| Alkyl polyglucoside | 0.5% |
| Ethyleneglycol butylether | 3.0% |
| Monoethanolamine | 0.5% |
| Polymer[1] | 0.1% |

Copolymer of di-quarternaryamide of methacrylic acid and acrylic acid.

TABLE 7

| | Water Drainage (g/ft$^2$) | |
|---|---|---|
| Pretreatment | 2nd Rinse | 3rd Rinse |
| Example A | 0.45 (sheeting) | 0.44 (sheeting) |
| Fantastik | 1.33 (droplets) | 1.84 (droplets) |

Illustrative Formulations

The following are examples of the inventive composition as formulated for specific applications. These examples are for illustrative purposes only and are not meant to limit the scope of the invention in any way.

TABLE 8

Glass Cleaner

| | Examples | |
|---|---|---|
| | 1 | 2 |
| Isopropanol | 3 | 1 |
| Propyleneglycol n-butyl ether | 1 | 1 |
| Ammonia | 0.3 | |
| Sodium lauryl sulfate | 0.5 | |
| Alkyl polyglucoside | | 0.5 |
| Ethylene diamine tetraacetic acid sodium salt | 0.3 | |
| Monoethanolamine | | 0.3 |
| Polymer A[1] | 0.1 | |
| Polymer B[2] | | 0.15 |

[1]Copolymer of acrylamide and acrylic acid (9:1 ratio).
[2]Copolymer of N,N-dimethylacrylamide and acrylamidopropenylmethylenesulfonic acid (19:1 ratio).

TABLE 9

All Purpose Cleaner

| | Examples | | |
|---|---|---|---|
| | 3 | 4 | 5 |
| Propyleneglycol n-butyl ether | 2.0 | 1.0 | |
| Dipropyleneglycol n-butyl ether | | 1.0 | 1.0 |
| Dimethyllauryl amineoxide | 0.5 | | |
| Alkyl polyglucoside | | 0.5 | |
| C12–13 alcohol 7-ethoxylate | | | 0.5 |
| Monoethanolamine | 0.3 | | 0.3 |
| Sodium hydroxide | | 0.2 | |
| Dimethyldioctylammonium chloride | | 0.1 | 0.1 |
| Polymer C[3] | 0.1 | | |
| Polymer D[4] | | 0.1 | |
| Polymer E[5] | | | 0.1 |

[3]Copolymer of trimethylammoniumpropylmethacrylate and acrylic acid (4:1 ratio).
[4]Copolymer of trimethylammoniumpropylmethacrylamide and acrylic acid (1:1 ratio).
[5]Copolymer of triethylammoniumpropylmethacrylate and maleic anhydride (3:1 ratio).

TABLE 10

Dilutable Cleaner

| | Examples | |
|---|---|---|
| | 6 | 7 |
| C12–13 alcohol 7-ethoxylate | 10 | 5 |
| C12–13 alcohol 3-ethoxylate | 2 | |
| Pine oil | | 10 |
| Monoethanolamine | 3 | 3 |
| Polymer F[6] | 0.1 | |
| Polymer G[7] | | 0.4 |

[6]Terpolymer of acrylamide, acrylic acid, ethylacrylate (10:3:1 ratio).
[7]Terpolymer of trimethylammoniumpropylmethacrylate, acrylic acid, and vinylacetate (5:5:2 ratio).

TABLE 11

Basic Bathroom Cleaner

| | Examples | |
|---|---|---|
| | 8 | 9 |
| Propyleneglycol n-propyl ether | 2 | 4 |
| Dimethyllauryl amineoxide | 1 | 1 |
| Monoethanolamine | 0.5 | 0.5 |
| Potassium hydroxide | 0.2 | 0.2 |
| Polymer H[8] | 0.01 | |
| Polymer I[9] | | 5.0 |

[8]Copolymer of N,N-dimethylacrylamide and styrenesulfonic acid (19:1 ratio).
[9]Terpolymer of trimethylammoniumpropylmethacrylate, acrylic acid, and ethylacrylate (1:2:2 ratio).

TABLE 12

Acidic Bathroom Cleaner

| | Examples | |
|---|---|---|
| | 10 | 11 |
| Diethyleneglycol butylether | 2 | |
| Isopropanol | | 3 |
| C12–13 alcohol 7-ethoxylate | 2 | |

TABLE 12-continued

| Acidic Bathroom Cleaner | Examples | |
|---|---|---|
| | 10 | 11 |
| Dowfax 2A1 | | 1 |
| Sulfamic acid | 2 | 1 |
| Citric acid | 3 | 2 |
| Polymer J[10] | 1 | |
| Polymer K[11] | | 0.3 |

[10]Copolymer of N, N-dimethylacrylamide and lauryl-5-ethoxyacrylate (1:1 ratio).
[11]Copolymer of acrylamide and methacrylic acid (2:3 ratio).

TABLE 13

| No Rinse Shower Cleaner | Examples | |
|---|---|---|
| | 12 | 13 |
| Isopropanol | 2 | 3 |
| Alkyl polyglucoside | 1 | 0.5 |
| Ethylenediaminetetraaceticacid diammonium salt | 0.5 | |
| Ethylenediaminetetraaceticacid sodium salt | | 1 |
| Dimethyldioctylammonium chloride | 0.2 | |
| Polymer L[12] | 0.05 | |
| Polymer M[13] | | 0.15 |

[12]Copolymer of N,N-dimethylacrylamide and PEG400-acrylate (1:1 ratio).
[13]Copolymer of di-quaternary derivative of methacrylamide and maleic anhydride (1:6 ratio).

TABLE 14

| Cleaning or Disinfecting Wipe | Examples | |
|---|---|---|
| Solution on polypropylene wipe | 14 | 15 |
| Isopropanol | 3 | 3 |
| C12–13 alcohol 7-ethoxylate | 0.5 | 0.5 |
| Monoethanolamine | 0.2 | |
| Citric acid | | 3 |
| Dimethyldioctylammonium chloride | 0.1 | 0.1 |
| Polymer N[14] | 0.2 | |
| Polymer O[15] | | 0.2 |

[14]Copolymer of N-methyl, N-vinylimidazolium and acrylic acid (1:4 ratio).
[15]Copolymer of vinylpyrrolidone and vinylacetate (1:1 ratio).

Performance Examples

Cleaning Performance on Bathroom Soil Build-Up

An acidic bathroom cleaner of the invention was prepared with various copolymers and tested against a cleaner with no copolymers and a commercial bathroom cleaner. Specifically, different amounts of copolymers were added to the base formulation to form the inventive compositions tested. A clean black tile was sprayed with two sprays of product followed in three minutes by four sprays of hard water (300 ppm, Ca:Mg=3:1). The tile was allowed to dry and the above product application cycle was repeated. To the dry tile, a simulated use condition treatment of four sprays of hard water followed by two sprays of 0.05% soap/sebum solution was applied and allowed to dry. This use condition treatment was repeated 10 times and the tile was graded for collection of soap/sebum soil on the tile. The results in Table 15 show that the inventive compositions were much better in preventing bathroom soil from adhering to tiles as compared to formulations without the inventive copolymer compositions.

| Base Formulation | |
|---|---|
| DI Water | Q.S. |
| Sulfamic Acid | 3.50% |
| Glycolic Acid | 1.50% |
| Dowfax 2A1 | 1.25% |
| Glucopon 325 | 0.50% |
| Dipropylene glycol n-butyl ether | 2.50% |
| Propylene gylcol-n-propylether | 1.50% |
| KOH | 2.00% |
| Polymer | Per Table 15 |

TABLE 15

| Polymer Concentration | Monomer ratio N,N-DMA[1] | AA[2] | AMPS[3] | M.W. | Score[4] |
|---|---|---|---|---|---|
| 0.50% | 90 | 10 | | 327,000 | 2.13 |
| 0.17% | 90 | 10 | | 327,000 | 2.70 |
| 0.50% | 90 | 8 | 2 | 118,000 | 3.70 |
| 0.50% | 90 | 8 | Hydrophobe | | 6.03 |
| 0.50% | 90 | 8 | Hydrophobe | | 6.03 |
| 0.50% | 80% | | 20% | 220,000 | 3.23 |
| 0.50% (Homopolymer) | Branched acrylamide | | | 100,000 | 7.03 |
| 0.50% (Homopolymer) | Branched acrylamide | | | 150,000 | 5.93 |
| 0.50% (Homopolymer) | Branched acrylamide | | | 200,000 | 6.27 |
| No Polymer | | | | | 8.36 |
| Lysol BT&T | | | | | 8.23 |
| Untreated | | | | | 8.10 |

[1]N,N-dimethylacrylamide
[2]Acrylic acid
[3]Acrylamidopropenylmethylenesulfonic acid
[4]Visual judging with 1 = Clean tile and 10 = Dirty Tile.

Cleaning Performance on Baked-on Kitchen Grease Build-Up

The following formula was used as a base for cleaning baked-on kitchen grease.

| | |
|---|---|
| DI Water | Q.S. |
| Berol 226 | 1.00% |
| Alkyl polyglucoside | 0.50% |
| Dowanol EB | 3.00% |
| Lonzabac MB50 | 0.30% |
| $K_4$EDTA | 0.44% |
| Mono-etholamine | 0.50% |
| Dye | 0.001 |

Table 16 below shows the effect of adding a copolymer of the inventive composition as a pretreatment. The cleaning formula was added as a pretreatment by wiping the tile with a damp sponge containing the cleaning formula. The tile was allowed to dry and then kitchen grease was baked onto the tile. The tile was then cleaned for 30 cycles with a damp sponge and evaluated for percent soil removal. The tiles treated with the polymer had significantly higher soil removal.

TABLE 16

| | Baked kitchen grease soil removal |
|---|---|
| No Pretreatment | 29% |
| Pretreat with base formula | 41% |
| Pretreat with base formula + 0.2% Polymer[1] | 95% |

Copolymer of di-quaternaryamide of methacrylic acid and acrylic acid.

Easier Next-Time Cleaning of Greasy Soils

Panelists were asked to clean oleoresin soil off tiles that had been pretreated by wiping with the Comparative Formula or Inventive Formula. They were then asked to rate the ease of cleaning from 1 to 10 (10=hard, 1=easy) using a wet sponge. Tiles pretreated with the Inventive Composition of polymer and APG removed the greasy soil more easily than the Comparative Formula, as shown in Table 17.

TABLE 17

| | Comparative Formula | Inventive Composition |
|---|---|---|
| Berol 226 | 1.00% | 0.8 |
| APG 325 | | 0.5 |
| Dowanol EB | 3.00 | 3.00 |
| Lonzabac MB50 | 0.30 | 0.30 |
| $K_4$EDTA | 0.44 | 0.44 |
| MEA | 0.50 | 0.50 |
| Colorant | 0.001 | 0.001 |
| Polymer[1] | | 0.15 |
| Balance Water | | |
| Ease of cleaning | 4.7 | 2.8 |

Copolymer of di-quarternaryamide of methacrylic acid and acrylic acid.

Cleaning Performance on Baked-on Kitchen Grease Build-Up

Table 18 below shows the effect of adding a copolymer of the Inventive Composition as a pretreatment. The cleaning formula was added as a pretreatment by wiping the tile with a damp sponge containing the cleaning formula. The tile was allowed to dry and then kitchen grease was baked onto the tile. The tile was then cleaned for 30 cycles with a damp sponge and evaluated for relative soil removal. The soil removal was measured by the increased reflection of the cleaned tile. The results show the Inventive Composition gave 30% greater kitchen grease removal than water and 18% greater kitchen grease removal than the Comparative Formula.

TABLE 18

| | Water | Comparative Formula | Inventive Composition |
|---|---|---|---|
| Berol 226 | | 1.00% | 1.00% |
| Dowanol EB | | 3.00 | 3.00 |
| Lonzabac MB50 | | 0.30 | 0.30 |
| $K_4$EDTA | | 0.44 | 0.44 |
| MEA | | 0.50 | 0.50 |
| Colorant | | 0.001 | 0.001 |
| Polymer[1] | | | 0.1 |
| Balance Water | 100% | | |
| Soil Removal | 1 | 1.1 | 1.3 |

[1]Copolymer of N, N-dimethylacrylamide and lauryl-5-ethoxyacrylate (1:1 ratio).

Cleaning Performance on Baked-on Kitchen Grease Build-Up

Table 19 below shows the effect of adding a polymer of the inventive composition as a pretreatment. The cleaning formula was added as a pretreatment by wiping the tile with a damp sponge containing the cleaning formula. The tile was allowed to dry and then kitchen grease was baked onto the tile. The tile was then cleaned for 30 cycles with a damp sponge and evaluated for percent soil removal. The tile was graded by panelists on a scale of 1 to 10 (10=no removal, 1=completely clean).

TABLE 19

| | Kitchen Grease |
|---|---|
| Water | 7.3 |
| Comparative Formula | 6.4 |
| Comparative Formula + 0.5% Polymer[1] | 5.6 |
| Comparative Formula + 1% polymer[1] | 4.0 |

[1]Copolymer of di-quarternaryamide of methacrylic acid and acrylic acid.

Polymer Gel Film Examples

Various formulations of the inventive compositions were also prepared and tested with respect to several characteristics relating to polymer gel films, including: (i) the uptake of water from the atmosphere increasing with increasing gel thickness; (ii) the adsorption of the copolymers from cleaning formulations; and (iii) the effect of increasing atmospheric humidity on the "next time" cleaning with water only.

FT-IR spectroscopic analysis was also employed in the following experiments. One particularly convenient optical accessory used was a device that is commercially available as the HORIZON from Harrick Scientific Corp., (Ossining, N.Y.). This optical accessory employs internal reflection elements (IREs) with dimensions of 50×10×3 mm. The IRE is mounted horizontally in the HORIZON, at the bottom of a "trough" that can contain about 2.5 ml of liquid. This design allows the IRE to be immersed in a solution and easily rinsed while remaining in place in the FT-IR spectrometer. A wide variety of protocols for treatment of the surfaces of IRE with prototypes and polymer solutions are possible with this accessory. A known volume of cleaning formulation can be applied to the surface of the IRE with a microsyringe and allowed to dry. The FT-IR spectrum of the film formed by the cleaning solution can be obtained. After treatment of the IRE with the cleaning solution, the trough can be filled with water to rinse the treated surface. The water can be rapidly removed from the trough with the use of a pipette tip fitted to the end of a length of tubing to which vacuum is applied. Using this approach, solutions can be rapidly "vacuumed" off the surface of the IRE. The fill and empty procedure constitutes a rinse of the treated IRE surface. Since the IRE surface area and the trough volume are fixed, very reproducible rinsing of treated IREs can be accomplished for the comparison of the effects of compositions by FT-IR spectroscopy.

A convenient method for controlling the water content of the atmosphere over the IRE surface is as follows. A small enclosure (8 cm×3 cm×3 cm) that fits over the exposed trough can be constructed from glass or plastic. Into this enclosure through flexible plastic tubing we direct extremely dry air or nitrogen (dew point approximately −100° F.) at a rate between 5 and 10 SCFH. The dry air or nitrogen used can come from the same source used to purge the interior of the FT-IR spectrometer, a typical practice. This approach allows the rapid and very complete drying of the surface of the IRE by covering it with a blanket of dry, flowing gas. In order to expose the IRE surface to the atmosphere, the small enclosure is removed. The FT-IR spectra of the IRE surface in the ambient atmosphere, or under extremely dry conditions, can thus be obtained.

In a typical experiment, twenty microliters of a cleaning composition or polymer solution is spread on the surface of the Ge IRE mounted in the HORIZON. The composition is allowed to dry. The treated surface is then rinsed by filling and emptying the trough with deionized water a number of times, e.g., 12 to 48 times. The rinsing step is used to remove residual components of the cleaning composition that give rise to a visible residue on the surface. A visual inspection of the IRE, which appears smooth and mirror-like, is done to determine if the film or residue on the surface could be seen. The treated surface is then dried by placing the enclosure over the IRE and waiting for at least 2 minutes. The FT-IR spectrum of the polymer gel in the dry atmosphere is then obtained. The enclosure is then removed, and another spectrum of the polymer gel in the ambient atmosphere is obtained. The enclosure can be replaced and removed several times, in order to cycle the gel through water loss and uptake from the atmosphere.

With FT-IR spectroscopy, a "background" or "single beam" spectrum of the clean IRE itself must be recorded first. The single beam spectrum of the IRE after adsorption of the polymers on the surface of the IRE is then recorded, and the final normal spectrum of the polymer gel is then computed from the ratio of these two single beam spectra. In the experiments described herein, the background spectrum of the IRE was obtained under the stream of dry air. The IREs were cleaned before each treatment by polishing with an alumina slurry (0.05 micrometer particles), followed by extensive rinsing with water, methanol, and water again.

Water is readily detected with FT-IR spectroscopy, yielding a characteristic spectrum with intense absorbance in several wavenumber ranges. The spectrum of liquid water exhibits absorption between approximately 3700 and 2600 $cm^{-1}$ (wavenumbers), with a maximum near 3370 $cm^{-1}$. This absorption is due to the stretching of the H—O bond of water. The change in the amount of absorbance near this wavenumber can be used to determine changes in the amount of water on the surface of the IRE caused by the uptake of water from the atmosphere by the polymers of this invention. The overall appearance of the FT-IR spectra can also indicate the presence of the polymer on the surface of the IRE. Different polymers will exhibit different spectra, depending on their chemical structure. The uptake of water from the atmosphere to form the thin gels will always result in the appearance of the characteristic spectrum due to liquid water, however, superimposed on the spectrum of the polymer. The lack of the presence of a polymer on the surface of the IRE can also be detected by the lack of its characteristic spectrum, whether or not the polymer interacts with water. The thickness of the polymer gels that are formed on the surface can be adjusted through proper selection of the components of the inventive compositions. The greater the amount of copolymer that is adsorbed per area on a surface, the greater the amount of water that is taken up by the gels when in contact with the atmosphere. The water uptake and amount of the polymer on the surface can be detected with FT-IR spectroscopy. The visual appearance of the surface remains unchanged when the very thin gels are present, however. Typically, the polymer gel that is formed generates a measurement of greater than 0.002 Absorbance Units in a Ge internal reflection element cell. Preferably, the polymer gel generates a measurement of greater than 0.01 Absorbance Units and more preferably greater than 0.02 Absorbance Units.

Since the background of the clean IRE is recorded under the dry air blanket, the FT-IR spectrum of the clean IRE surface under the dry air blanket will show essentially no evidence of liquid water, i.e the absorbance at approximately 3370 $cm^{-1}$ in the spectrum, and indeed across the entire spectrum is essentially 0. The spectrum of the clean IRE was checked in this manner before each experiment, in order to ensure that no significant changes in water content occurred since recording the background spectrum several minutes earlier.

Removal of the blanket and exposure of the clean IRE to the atmosphere will result in the absorption of a very small amount of water as the surface re-equilibrates with the atmosphere. Therefore, there is a small increase in water on the surface of the clean IRE that can be considered a "blank" in the measurement. The increase in the amount of water on the surface in the "blank" measurements was consistently less than 0.002 Absorbance units (AU). The uptake of water by the polymer gels formed from the inventive compositions was measured in the same way.

The Amount of Water Uptake is Proportional to Polymer Gel Thickness

In this experiment, known amounts of a nonionic polymer of N,N dimethylacrylamide copolymerized with acrylic acid that was available as ALCO EXP 4191 from ALCO Chemical, Chattanooga Tenn. were spread on the surface of the IRE from dilute solution. For example, fifty microliters of a 0.002267% solution were applied to yield 0.1335 micrograms of polymer spread over the 3.75 sq. cm of the Ge IRE mounted in the HORIZON accessory. The solution was allowed to dry, and then the spectra of the polymer gel under the dry air blanket, and in contact with the ambient atmosphere were recorded. Similar preparation schemes in which from 50 to 150 microliters of dilute solutions of ALCO 4191 (0.0267%) were applied to the IRE were used to produce polymer gels of increasing thickness and containing known amounts of polymer. The polymer gels on the IRE were not visible to the unaided eye. A "blank" run was done on the same day, with the same IRE, comparing the re-equilibration of the clean, untreated IRE with the atmosphere, after drying under the flowing dry air blanket.

Table 20 shows that the amount of water taken up by the polymers from the atmosphere on the surface of the IRE increases with the amount of polymer present.

TABLE 20

| Weight of polymer applied to IRE, micrograms | Difference in absorbance of water @ 3370 $cm^{-1}$ (Absorbance in ambient air − absorbance under dry air blanket) | Surface properties |
|---|---|---|
| None - "blank" | 0.001141 | |
| None - "blank" run 2 | 0.001257 | No film visible |
| None - "blank" run 3 | 0.001039 | No film visible |
| 0.1335 | 0.002109 | No film visible |
| 13.4 | 0.031135 | No film visible |
| 53.4 | 0.058807 | No film visible |
| 184 | 0.117659 | Slight haze on IRE |

Reversibility of Water Uptake in Polymer Gels

In this experiment, the uptake or sequestering of water from the atmosphere was monitored by obtaining spectra of a polymer gel comprised of ALCO 4191 polymer under the dry air blanket, immediately after removal of the blanket (during the first two minutes, which is the time required to obtain the spectrum with the spectrometer employed), and at longer times in the ambient air. The results in Table 21 show that the uptake of water is very rapid, since the absorbance of the water band is nearly constant over 10 minutes. The reversibility of the uptake of water by the gels was also confirmed by replacing the dry air blanket over the gel for 5 minutes, and then exposing the gel to the ambient atmosphere once again. The results in Table 21 show that the uptake of water by the polymer gel is reversible.

TABLE 21

| Treatment | Difference in absorbance of water @ 3370 $cm^{-}$ (absorbance in ambient air – absorbance under dry air blanket) |
|---|---|
| Immediate first exposure to atmosphere | 0.0311 |
| 5 minutes after first exposure | 0.0313 |
| 10 minutes after first exposure | 0.0311 |
| Immediate - second exposure after drying | 0.0292 |
| 5 minutes after second exposure | 0.0297 |
| Immediate - third exposure after drying | 0.0287 |
| 5 minutes after third exposure | 0.0292 |

Adsorption of Copolymers from a Cleaning Composition

In this experiment, the adsorption of an amino amphoteric polymer co-polymerized with acrylic available as Rhodia CV-3 from Rhodia Inc. of Cranbury N.J. onto the surface from a commercial cleaning formulation, FORMULA 409 All Purpose Cleaner from the Clorox Co. (Oakland, Calif.) was demonstrated. Twenty microliters of the cleaning formulation, to which different amounts of the polymer were added, was dried on the surface of the IRE, and then rinsed with deionized water by filling and emptying the trough of the HORIZON 12 times. The polymer gel obtained was then dried under the dry air blanket for 3 minutes, followed by exposure to the atmosphere. A second drying cycle was done by replacing the dry air blanket for 3 minutes, and then a second exposure (cycle 2) to the atmosphere was made. After this protocol was completed, the same polymer gel was rinsed another 12 times (for a total of 24 rinses) with deionized water and the drying/exposure protocol was repeated.

Table 22 shows that this copolymer adsorbs on the IRE surface and forms a thin polymer gel by uptake of water from the atmosphere, even at low concentrations in the original cleaning formulation. The polymer gel is resistant to rinsing with deionized water, as demonstrated by the data at 12 and 24 rinses. The "blank" run shows the change in the amount of water on the surface of a clean IRE after removing it from under the dry air blanket and exposing it to the atmosphere on the same day as the other two experiments.

TABLE 22

| Treatment | Formula 409 with 0.2% Rhodia DV-3 polymer. Difference in absorbance of water @ 3370 cm (absorbance in ambient air – absorbance under dry air blanket) | Formula 409 with 1.0% Rhodia DV-3 polymer. Difference in absorbance of water @ 3370 cm (absorbance in ambient air – absorbance under dry air blanket) | Surface Properties |
|---|---|---|---|
| 12x rinse, cycle 1 in atmosphere | 0.00190 | 0.003592 | No film visible Hydrophilic |
| 12x rinse, cycle 2 | 0.00187 | 0.00334 | No film visible Hydrophilic |

TABLE 22-continued

| Treatment | Formula 409 with 0.2% Rhodia DV-3 polymer. Difference in absorbance of water @ 3370 cm (absorbance in ambient air – absorbance under dry air blanket) | Formula 409 with 1.0% Rhodia DV-3 polymer. Difference in absorbance of water @ 3370 cm (absorbance in ambient air – absorbance under dry air blanket) | Surface Properties |
|---|---|---|---|
| 24x rinse, cycle 1 | 0.00166 | 0.003198 | No film visible Hydrophilic |
| 24x rinse, cycle 2 | 0.00157 | 0.002975 | No film visible Hydrophilic |
| Blank run, clean IRE, same day | 0.00091 | | No film visible |

Commercial Cleaners Require Inventive Polymers to Form Polymer Gel

In this experiment, twenty microliters of two commercial all purpose cleaning formulations which do not have the inventive polymers were used to treat the surface of the IRE, and rinsed with deionized water to remove the non-adsorbing components of the formulations. The IRE was then dried using the dry air blanket, followed by exposure to the atmosphere. FT-IR was used to compare the change in the surface water content of the IRE treated with these formulations. These formulations do not deliver copolymers that can form gels and do not provide increased water contents on the surfaces. In fact, due to the adsorption of other components from the formulations, there is a slight decrease in the water taken up by the surface, due to the residues, compared to a clean IRE control run on the same day. Table 24 shows the results. These formulations cause a net decrease in the hydrophilicity of the surfaces they are used to clean. This decrease in surface water content can also be detected by the increases in the water contact angles caused by use of these formulations.

TABLE 24

| Treatment | Formula 409 All Purpose Cleaner-No Polymer Added. Difference in absorbance of water @ 3370 $cm^{-1}$ (absorbance in ambient air – absorbance under dry air blanket) | Lysol Lemon Fresh All Purpose Cleaner-No Polymer Added. Difference in absorbance of water @ 3370 $cm^{-1}$ (absorbance in in ambient air – absorbance under dry air blanket) | Surface Appearance |
|---|---|---|---|
| 12 rinses | 0.000595 | 0.000897 | No film visible, beads water |
| 24 rinses | 0.000582 | 0.000892 | No film visible, beads water |
| Clean IRE blank run same day as 409 | 0.000706 | N/A | No film visible |
| Clean IRE blank run same day as Lysol Lemon Fresh | N/A | 0.001391 | No film visible |

In a related experiment, a commercial all purpose cleaner (FORMULA 409) was used to prepared two test compositions each containing a different polymer: (i) 90,000 MW 1-vinyl-2-pyrrolidone PVP K90 from ISP Inc. of Wayne. N.J. and (ii)polyquaterium 11, poly(vinlypyrrolidone/dimethylaminoehtyl-methacrylate) copolymer, quaternized and available under the tradename GAFQUAT 440 from ISP Inc. In addition, a third test composition comprising an acid bathroom cleaner containing an acid bathroom cleaner 4500 MW polyacrylic acid polymer available under the tradename ACUSOL 445 from Rohm and Haas Co. Spring House Pa. was prepared. (The base formulation of the acid bathroom cleaner was described above.) Twenty microliters of each test composition was used to treat the surface of the IRE, and rinsed with deionized water to remove the non-adsorbing components of the formulations. The IRE was then dried using the dry air blanket, followed by exposure to the atmosphere. FT-IR was used to compare the change in the surface water content of the IRE treated with these formulations. These formulatios also did not form polymer gels as evidenced by the data in Table 25. As is apparent, not all polymers are capable of adsorbing water repeatedly with rinsing.

TABLE 25

| Treatment | Formula 409 All Purpose Cleaner-0.2% PVP K90. Difference in absorbance of water @ 3370 $cm^{-1}$ (absorbance In ambient air – absorbance under dry air blanket) | Formula 409 All Purpose Cleaner-0.2% Gafquat 440. Difference in absorbance of water @ 3370 $cm^{-1}$ (absorbance in ambient air – absorbance under dry air blanket) | Acidic Bathroom Cleaner with Acusol 445 | Surface Appearance |
|---|---|---|---|---|
| 12 rinses | N/A | 0.000671 | 0.000723 | No film visible |
| 24 rinses | 0.000665 | 0.000676 | 0.000816 | No film visible |
| Clean IRE blank run same day as 409 with PVP K90 | 0.000876 | N/A | N/A | No film visible |
| Clean IRE blank run same day as 409 with Gafquat | N/A | 0.00098 | N/A | No film visible |
| Clean IRE blank run same day as acidic bathroom cleaner with Acusol 445 | N/A | N/A | 0.000874 | No film visible |

Effect of Atmospheric Humidity on "Next Time" Cleaning

In this experiment, the "next time easier cleaning" benefit provided by the adsorption of the thin polymer gels onto a household surface was measured. Initially, it was demonstrated that polymer gels of the present invention take up more water with increasing humidity. In addition, the higher water level enhances the removal of grease from surfaces coated with the polymer gel. Specifically, two formulations: (i) a base formulation (Base) and (ii) the base formulation with 0.15% active Rhodia CV-3 (Base plus Polymer) were prepared. The base formulation comprised the components set forth in above Table 17 under "comparative formula." Porcelain-enameled tiles were sprayed with a formulation and wiped with a sponge before being placed in chambers set at different relative humidities and temperatures. The tiles were left overnight to permit them to equilibrate. The tiles were then each sprayed with about 0.2 g of kitchen grease and then baked at 180° C. for 20 minutes. Subsequently, the tiles were wiped with a wet sponge with an automatic scrubber. The amount of grease removed from each tile was measured with an optical device. For each set of tiles, amount of grease removed from the tile coated with just the base formulation was normalized to a value of 1. Thus, in comparing the first set of tiles where the baking conditions were 70° F. and 50% RH, the tile coated with the polymer gel achieved a score of 1.4, i.e., that is a 40% improvement in terms of grease removal. In addition, the data set forth in Table 26 show that the relative grease removal improvements rise with the temperature and/or relative humidity. The results support the conclusion that polymer treated surfaces allowed to equilibrate at varying relative humidities and temperatures will have lower surface energy, and thus greasy soils will be easier to remove.

TABLE 26

| Tile: cleaning formulation and bake conditions | Kitchen Grease Soil Removal |
|---|---|
| Base 70° F. - 50% RH | 1.0 |
| Base plus polymer 70° F. - 50% RH | 1.4 |
| Base 70° F. - 70% RH | 1.0 |
| Base plus polymer 70° F. - 70% RH | 1.5 |
| Base 90° F. - 70% RH | 1.0 |
| Base plus polymer 90° F. - 70% RH | 2.6 |
| Base 80° F. - 80% RH | 1.0 |
| Base plus polymer 80° F. - 80% RH | 2.8 |

The foregoing has described the principles, preferred embodiments, and modes of operation of the present invention. However, the invention should not be construed as limited to the particular embodiments discussed. Instead, the above-described embodiments should be regarded as illustrative rather than restrictive, and it should be appreciated that variations may be made in those embodiments by workers skilled in the art without departing from the scope of the present invention as defined by the following claims.

What is claimed is:

1. A method of forming a hydroscopic polymer gel film on a surface that comprises:

(a) applying a water soluble or water dispersible polymer on the surface to form a layer of the polymer on the surface; and (b) allowing water to be sequestered to the layer to form the polymer gel film wherein said hydroscopic polymer gel film has a thickness that ranges from about 0.1 nm to 500 nm and is not visible and wherein the hydroscopic polymer gel film creates low water contact angles which result in lowered energy of adhesion of oil.

2. The method of claim 1 wherein the polymer is adsorbed onto the surface.

3. The method of claim 1 wherein the polymer is not covalently bonded to the surface.

4. The method of claim 1 wherein step (a) comprises the steps of (i) formulating an aqueous composition comprising the water soluble or water dispersible polymer and one or more adjuvant components and (ii) applying the composition on the surface.

5. The method of claim 4 wherein the one or more adjuvant components is selected from the group consisting of dyes, fragrances, buffers, salts, and mixtures thereof.

6. The method of claim 1 wherein step (b) comprises allowing water from the ambient environment to be sequestered to the layer to form the polymer gel.

7. The method of claim 6 wherein the thickness of the polymer gel formed depends on the temperature and relative humidity of the ambient environment.

8. The method of claim 1 wherein the polymer gel film protects the surface against wetting by oil.

9. The method of claim 1 wherein step (a) comprises applying the water soluble or water dispersible polymer onto a hard surface thereby rendering the hard surface hydrophilic.

10. The method of claim 1 wherein step (a) comprises applying the water soluble or water dispersible polymer onto the surface of fabric.

11. A method of modifying a selected surface area as a site for chemical reaction comprising the steps of: (a) applying a composition containing a water soluble or water dispersible polymer on the selected surface to form a layer of the polymer on the selected surface; (b) allowing water to be sequestered to the layer to form a hydroscopic polymer gel film wherein said hydroscopic polymer gel film has a thickness that ranges from about 0.1 nm to 500 nm and is not visible.

12. The method of claim 11 wherein the composition comprises one or more first components and the method further comprises step (c) whereby one or more second components are exposed to the one or more first components whereupon a reaction between the one or more first components and the one or more second components occurs.

13. The method of claim 1, wherein step (a) comprises applying a composition that comprises: (a) a water soluble or water dispersible copolymer having: (i) a first monomer that has a permanent cationic charge or that is capable of forming a cationic charge on protonation; (ii) at least one of a second monomer that is acidic and that is capable of forming an anionic charge in the compositions or a third monomer that has an uncharged hydrophilic group; and (iii) optionally, a fourth monomer that is hydrophobic; (b) optionally, an organic solvent; and (c) optionally, an adjuvant.

14. The method of claim 13 wherein the copolymer includes a second monomer and the mole ratio of the first monomer to second monomer ranges from 19:1 to 1:10.

15. The method of claim 14 wherein the copolymer includes a second monomer and mole ratio of the first monomer to second monomer ranges from 9:1 to 1:6.

16. The method of claim 13 wherein the copolymer includes a third monomer and the mole ratio of the first monomer to third monomer ranges from 4:1 to 1:4.

17. The method of claim 16 wherein the copolymer includes a third monomer and the mole ratio of the first monomer to third monomer ranges from 2:1 to 1:2.

18. The method of claim 13 wherein the first monomer is selected from the group consisting of acrylamide, N,N-dimethylacrylamide, methacrylamide, N,N-dimethylmethacrylamide, N,N-di-isopropylacrylamide, and mixtures thereof.

19. The method of claim 13 wherein the first monomer is selected from the group consisting of N-vinylimidazole, N-vinylpyrrolidone, dialkylaminoethylmethacrylate, dialkylaminoethylacrylate, dialkylaminopropylmethacrylate, dialkylaminopropylacrylate, dialkylaminoethylmethacrylamide, dialkylaminoethylacrylamide, dialkylaminopropylmethacrylamide, dialkylaminopropylacrylamide, and mixtures thereof.

20. The method of claim 13 wherein the first monomer is selected from the group consisting of N-alkylvinylimidazolium, N-alkyl, N-vinylpyrrolidonium, trialkylammoniumethylmethacrylate, trialkylammoniumethylacrylate, trialkylammoniumpropylmethacrylate, trialkylammoniumpropylacrylate, trialkylammoniumethylmethacrylamide, trialkylammoniumethylacrylamide, trialkylammoniumpropylmethacrylamide, trialkylamimoniumpropylacrylamide, di-quaternary derivatives of methacrylamide, and mixtures thereof.

21. The method of claim 13 wherein the copolymer includes a second monomer that is selected from the group consisting of acrylic acid, methacrylic acid, maleic anhydride, succinic anhydride, vinylsulfonate, styrene sulfonic acid, sulfoethylacrylate, acrylamidopropenylmethylenesulfonic acid and mixtures thereof.

22. The method of claim 13 wherein the copolymer includes a third monomer that is selected from the group consisting of vinyl alcohol, vinyl acetate, hydroxyethylacrylate, and alcohol ethoxylate esters, alkylpolyglycoside esters, and polyethylene glycol esters of acrylic, methacrylic acid, ethylene oxide, propylene oxide, and mixtures thereof.

23. The method of claim 13 further comprising a surfactant.

24. The method of claim 23 wherein the surfactant is nonionic.

25. The method of claim 13 which comprises an adjuvant that is selected from the group consisting of buffering agents, builders, hydrotropes, fragrances, dyes, colorants, solubilizing materials, stabilizers, thickeners, defoamers, enzymes, bleaching agents, cloud point modifiers, preservatives, and mixtures thereof.

26. The method of claim 13 further comprising an organic solvent.

27. The method of claim 13 wherein the copolymer comprises from 0.01% to 20% by weight of the composition.

28. The method of claim 13 wherein the copolymer comprises from 0.1% to 5% by weight of the composition.

29. The method of claim 13 wherein the composition comprises at least 70% by weight water.

30. The method of claim 23 wherein the surfactant comprises from 0.01% to 10% by weight of the composition.

31. The method of claim 13 wherein the solvent comprises from 0.01% to 10% by weight of the composition.

32. The method of claim 1 wherein the polymer gel that is formed generates a measurement of greater than 0.002 Absorbance Units in a Ge internal reflection element cell.

33. The method of claim 1 wherein the polymer gel generates a measurement of greater than 0.01 Absorbance Units in a Ge internal reflection element cell.

34. The method of claim 1 wherein the polymer gel generates a measurement of greater than 0.02 Absorbance Units in a Ge internal reflection element cell.

35. The method of claim 32 wherein step (a) comprises (i) applying an aqueous composition containing the water soluble or water dispersible polymer onto the surface and (ii) removing a majority of the aqueous composition to form the layer of polymer.

36. The method of claim 1, wherein the polymer gel film enhances release of soil.

37. The method of claim 11, wherein step (a) comprises applying a composition that comprises:

(a) a water soluble or water dispersible copolymer having:

i. a first monomer that has a permanent cationic charge or that is capable of forming a cationic charge on protonation;

ii. at least one of a second monomer that is acidic and that is capable of forming an anionic charge in the compositions or a third monomer that has an uncharged hydrophilic group; and iii. optionally, a fourth monomer that is hydrophobic;

(b) optionally, an organic solvent; and (c) optionally, an adjuvant.

38. The method of claim 1, wherein the low water contact angles are less than about 10°.

39. The method of claim 36, wherein the soil is hydrophobic soil.

40. The method of claim 9, wherein the hard surface is a vitreous surface.

41. The method of claim 1, further comprising (c) rinsing said surface with an aqueous solution.

42. The method of claim 41, wherein said aqueous solution comprises a hardwater solution.

43. The method of claim 42, wherein said hydroscopic polymer gel film retains less than 1.25 gram per square foot of water after the film undergoes the following additional treatment steps:

(i) wetting with hard water;

(ii) draining for about 10 minutes;

wherein said film is held at an angle of about 52°.

44. The method of 43, wherein said hydroscopic polymer gel film retains less than 1.0 gram per square foot of water.

45. The method of claim 43, wherein said hydroscopic polymer gel film retains less than 0.5 gram per square foot of water.

* * * * *